US005385584A

United States Patent [19]

Teramura et al.

[11] Patent Number: 5,385,584

[45] Date of Patent: Jan. 31, 1995

[54] METHOD OF DYEING A WEBBING OF A SEAT BELT DEVICE

[75] Inventors: Katsuhiko Teramura; Tsuneo Chikaraishi; Kiyokazu Hamada, all of Shiga, Japan

[73] Assignee: Takata Corporation, Tokyo, Japan

[21] Appl. No.: 30,615

[22] Filed: Mar. 12, 1993

[30] Foreign Application Priority Data

Mar. 19, 1992 [JP] Japan ..... 4-063440

[51] Int. Cl.[6] ..... D06B 3/18

[52] U.S. Cl. ..... 8/149.1; 68/5 D; 8/500; 8/505; 8/922; 8/932; 8/933

[58] Field of Search ..... 8/400, 465, 500, 505, 8/489, 149.1, 922, 932, 933; 68/5 D

[56] References Cited

U.S. PATENT DOCUMENTS

| | | | |
|---|---|---|---|
| 4,025,305 | 5/1977 | Fleissner | 8/505 |
| 4,244,690 | 1/1981 | Sato et al. | 8/465 |
| 4,465,490 | 8/1984 | von der Eltz | 8/400 |

*Primary Examiner*—Paul Lieberman
*Assistant Examiner*—Margaret Einsmann
*Attorney, Agent, or Firm*—Kanesaka & Takeuchi

[57] ABSTRACT

A method of dyeing a webbing of a seat belt device having a step of padding a dye to a raw material for a webbing and a subsequent step of introducing the webbing into a hot blow furnace and color developing, wherein a webbing in a moistened state by padding of the dye is introduced into a hot blow furnace and drying and color development are conducted in the hot blow furnace.

6 Claims, 4 Drawing Sheets

METHOD OF DYEING A WEBBING OF A SEAT BELT DEVICE

FIELD OF THE INVENTION

The present invention concerns a method of dyeing a webbing of a seat belt device disposed in a vehicle or the like for constraining or protecting a passenger.

More particularly, it relates to a method of dyeing a webbing suitable for continuous dyeing.

DESCRIPTION OF THE RELATED ART

Description will now be made to an existent method of dyeing a webbing of a seat belt device with reference to FIG. 2.

In FIG. 2, a raw material for a webbing 1 is at first sent to a dye padding step 3 and deposited with a dye. Usually, padding is applied by immersing the webbing in a dye solution and, then, squeezing the same.

The padded webbing is introduced into an infrared heating furnace 4 and put to preliminary drying. Then, it is sent to a hot blow furnace 4*a* and dried by contact with a hot blow at 120° C. Then, it is passed through a first tensioner 5 and then sent to a hot blow furnace 6, in which the dye develops a color in contact with a hot blow at 210°-220° C. Subsequently, the webbing leaving the hot blow furnace 6 is passed through a second tensioner 7.

Each of the first tensioner 5 and the second tensioner 7 comprises a pinch roller mechanism of delivering the webbing while putting it therebetween. There is a difference of delivery speed (roller circumferential speed) between the first tensioner 5 and the second tensioner 7, and the webbing is adjusted to a predetermined elongation by variously controlling the difference.

The webbing delivered from the second tensioner 7 is sent to a reduction cleaning step 8. The reduction cleaning is a cleaning step of applying a reducing treatment for deposits on the webbing (not fixed dye) by passing the webbing in a cleaning solution comprising a mixture of a reducing agent and a surface active agent (cleaning agent).

The webbing applied with the reduction cleaning is then sent to a hot water cleaning step 9. In the hot water cleaning step, the webbing is immersed in hot water and the deposits are washed out. The webbing after the hot water washing is then passed through a drying step 10, a resin padding step 11, a resin drying and setting step 12 and a softening step 13 and then taken out.

FIG. 3A shows a schematic constitution of a hot blow furnace in the prior art. In the hot blow furnace 6, rollers 6*a*, 6*b* are disposed above and below in multistage, in which the webbing 1 is laid around the rollers 6*a* on the upper stage and the rollers 6*b* on the lower stage alternately and caused to stay for a predetermined period of time in the hot blow furnace 6.

Further, FIG. 4A shows a cleaning (reduction cleaning and hot water washing) step in the prior art. Reference numeral 7*a* denotes a water bath in which a cleaning solution or hot water is stored. A plurality of lower stage rollers 7*b* is disposed so as to be immersed in the cleaning solution or hot water, while a plurality of other rollers 7*c* are disposed above the liquid level. The webbing 1 is laid around the rollers 7*c*, 7*b* alternatively and put to cleaning while getting into and out of the solution.

The method of dyeing the webbing of the seat belt device in the prior art as described above involves the following problems.

(1) Since the padded webbing is guided by a plurality of rollers till it is completely dried, a dye deposited to the webbing is attached to the plurality of rollers. Therefore, when the kind of the dye is changed for color change, a plurality of rollers has to be cleaned, to takes a much time for color change.

(2) In particular, the dye deposited to the rollers in the hot blow furnace is dried to solidness and difficult to be removed. Therefore, it takes a much time for the cleaning of the rollers in the hot blow furnace.

(3) Since the raw material for the webbing deposited with an oil agent (ester type oil dispersed in water with surface active agent) is sent as it is to the padding step and immersed in a dye bath, the oil agent is liable to be mixed with a dye solution in the dye bath. If the dye mixed with the oil agent is deposited to the webbing, no expected color development can be obtained.

(4) The oil agent becomes tarry owing to high temperature (210°-220° C.) in a color forming furnace to contaminate the webbing.

(5) Since the oil agent remains on the webbing, removal of contamination upon reduction cleaning is not satisfactory.

(6) It requires a number of drying steps, to make the entire step lengthy.

(7) During cleaning, the webbing is bent only in one direction in the solution. By the way, in the prior art shown in FIG. 4A, the webbing is bent only on the side thereof in contact with the roller. Accordingly, the cleaning solution or hot water can scarcely intrude deeply to the fibrous tissue of the webbing, thereby tending to make the cleaning insufficient.

OBJECT AND THE SUMMARY OF THE INVENTION

A first aspect for the in accordance with the present invention provides a method of dyeing a webbing of a seat belt device comprising a step of padding a dye to a raw material of the webbing and a step of introducing the webbing into a hot blow furnace for color development, wherein a webbing put into a moistened state by padding of the dye is introduced in a hot blow furnace, and drying and color development are conducted in the hot blow Furnace.

A second aspect of the present invention provides a method of dyeing a webbing of a seat belt device as defined in the first aspect, which comprises washing a raw material of the webbing with water thereby removing an oil agent deposited thereon and, subsequently, sending the webbing in a wet state as it is to the padding step.

A third aspect of the present invention provides a method of dyeing a webbing of a seat belt device as defined in the first aspect, wherein a roller with which the webbing introduced into the hot blow furnace is in contact at first, is disposed to the downstream of a drying zone in the hot blow furnace.

A fourth aspect of the present invention provides a method of dyeing a webbing of a seat belt device as defined in the first aspect, in which, a webbing from the hot blow furnace is put to reduction cleaning and then to hot water washing by passing it in the hot water bath, wherein a step of bending the webbing in the direction of one side thereof and a step of bending the webbing in the direction of the other side thereof are repeated in a cleaning bath and/or hot water bath upon conducting the reduction cleaning and/or hot water washing.

According to the first aspect for the method of dyeing the webbing of the seat belt device, the padded webbing is introduced without preliminary drying into the hot blow furnace. Therefore, the number of drying steps is reduced. Further, since the number of rollers in contact with the moistened padded webbing is reduced, color change for the dye can be conducted rapidly. The webbing usually comprises a woven fabric of synthetic fibers such as polyethylene terephthalate and has extremely low water absorption. Therefore, the water content in tile padded webbing is low and a webbing that sufficiently develops a fine color can be produced without preliminary driving.

According to the second aspect for the method of dyeing the webbing of a seat belt device, since padding is applied after removing the oil agent, the oil agent does not leach into the dye solution in the dye bath. Therefore, contamination of the dye solution can be prevented. Further, contamination upon reduction cleaning can be removed satisfactorily. Further, the oil agent does not become tarry and contaminate the webbing in the hot blow furnace. Accordingly, a webbing that develops an extremely fine color can be obtained.

Further, since the webbing shows extremely low water absorption, it can be put to padding after water washing without drying. That is, since the webbing contains less water, the dye solution is scarcely or not diluted even if the water washed webbing is immersed in the dye solution.

In the third aspect for the method of dyeing a webbing of a seat belt device, the webbing is brought into contact with the rollers in the hot blow furnace only after the webbing has been introduced into the hot blow furnace and dried sufficiently. Accordingly, the dye does not deposit to the rollers in the hot blow furnace to prevent deposition and drying to solidness of the dye to the rollers in the hot blow furnace. Therefore, color of the dye can be changed rapidly.

According to the fourth aspect for the method of dyeing a webbing of a seat belt device, since the webbing is bent repeatedly in the directions of one side and the other side thereof in the reduction cleaning bath and/or hot water washing bath, hot water can intrude deeply into the fibrous tissue of the webbing. This can attain effective hot water washing to the webbing.

PREFERRED EMBODIMENTS

Figure 1:
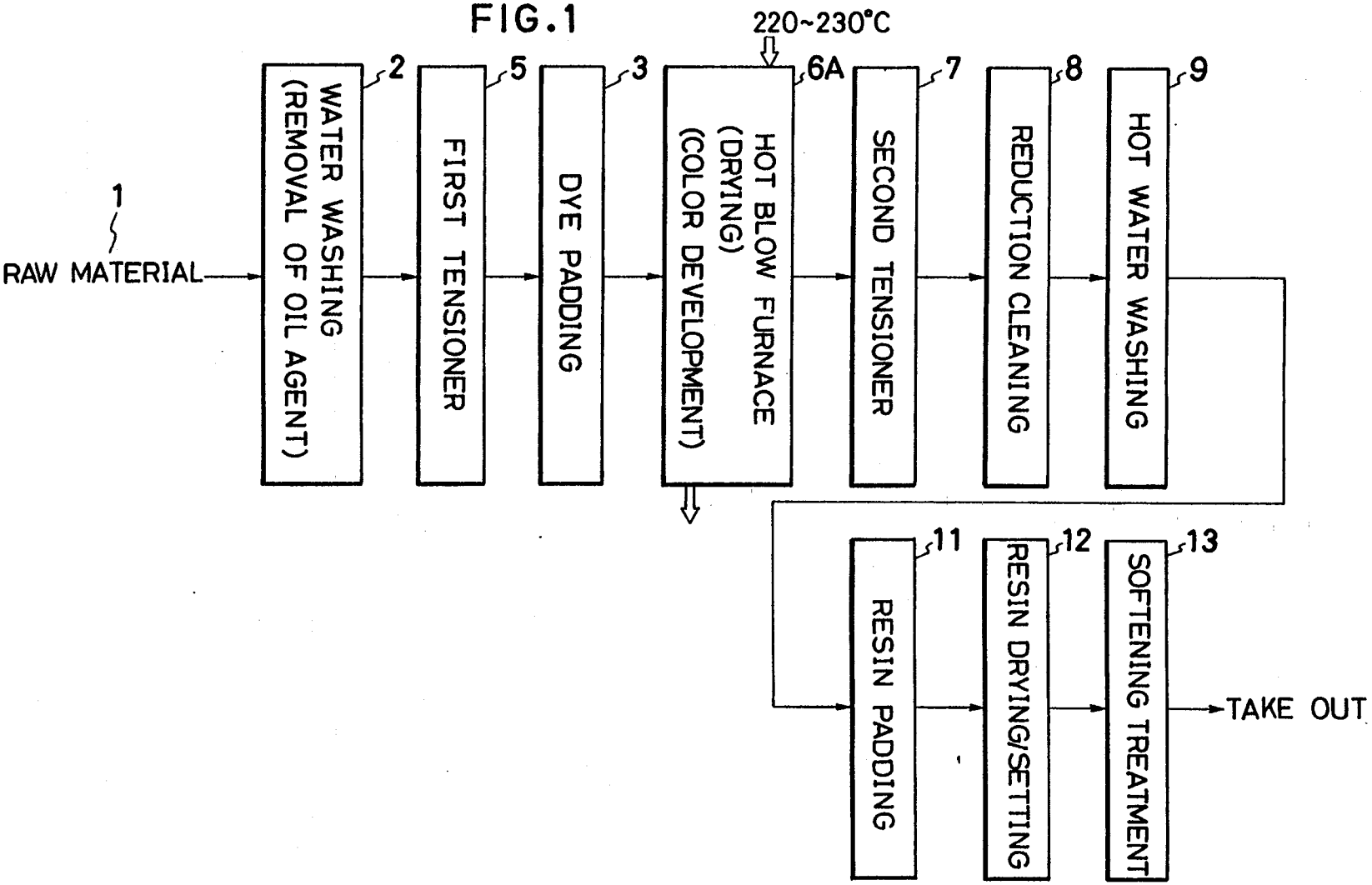
FIG. 1 is a step chart illustrating a preferred embodiment of the present invention.
Figure 2:
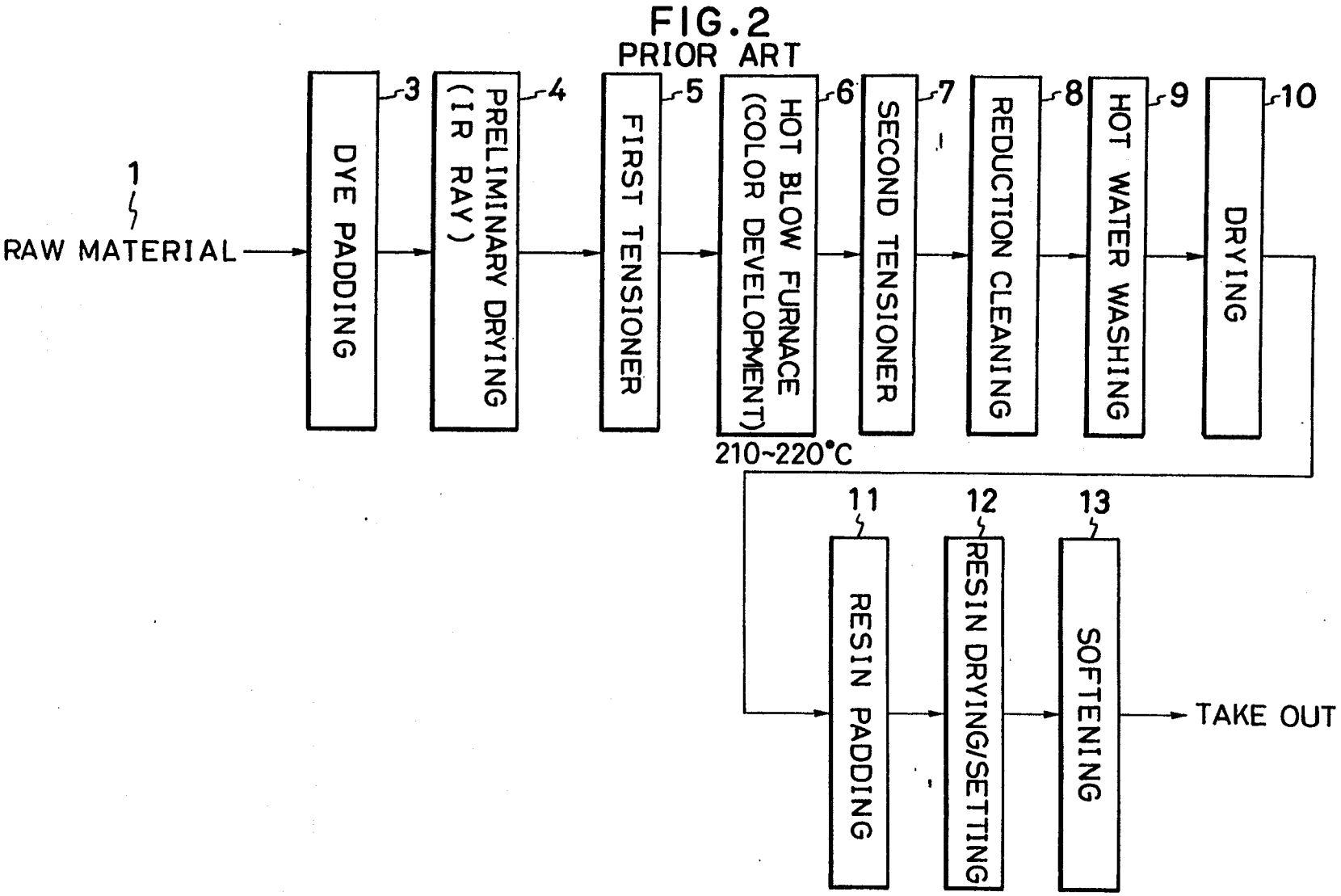
FIG. 2 PRIOR ART
FIG. 2 is a step chart illustrating an embodiment in the prior art.

Description will now be made to a preferred embodiment with reference to the drawings. FIG. 1 is a system chart For illustrating the method of the preferred embodiment according to the present invention.

In this embodiment, a raw material for a webbing 1 is at first sent to a water washing step 2, in which an oil agent is removed. In this water washing step, since the webbing 1 is immersed into water in a water bath, the oil agent deposited thereon leaches into water, so that the oil agent is removed. The webbing removed with the oil agent is then sent by way of a first tensioner 5 to a dye padding step 3. The webbing deposited with the dye is sent as it is to a hot blow furnace 6A. The webbing 1 is brought into contact with a hot blow in the hot blow furnace 6A and is at first put to drying and then color development.

The webbing leaving the hot blow furnace 6A passes through a second tensioner 7 and then passes through a reduction cleaning step 8 and a hot water washing step 9. The webbing leaving the hot water washing step 9 is sent directly, without drying, to a resin padding step 11 and, subsequently, passed through a resin drying/setting step 12 and softening step 13 and then taken out as a dyed webbing in the same manner as in the prior art.

Figure 3B:
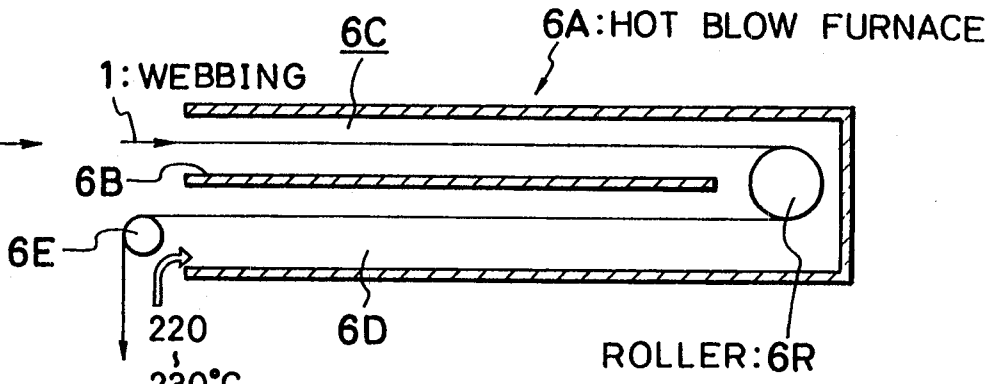
FIG. 3A and FIG. 3B are cross sectional views illustrating a hot blow furnace.
Figure 3A:
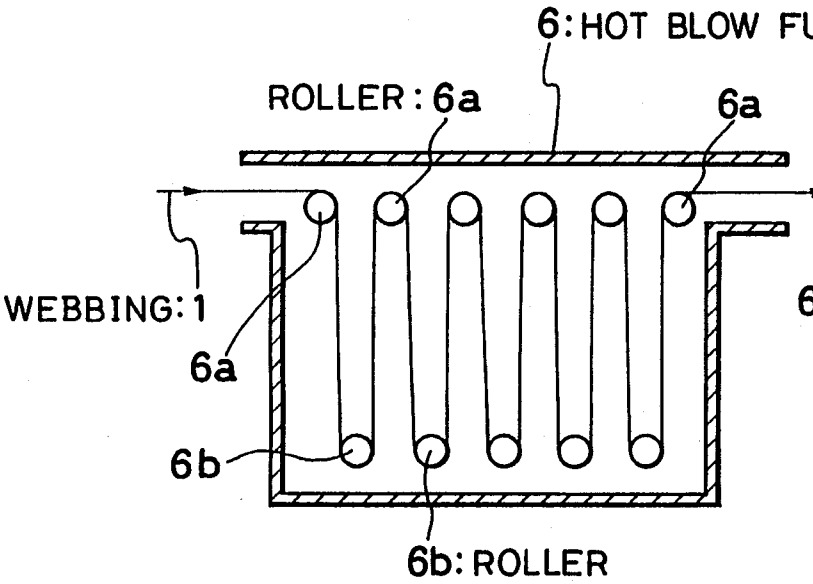

FIG. 3B schematically shows the constitution of a hot blow furnace 6A used in this embodiment. The hot blow furnace 6A is elongate in a horizontal direction and partitioned by a partitioning wall 6B into a drying zone 6C and a color developing zone 6D. Then, a roller 6R is disposed at the deepest portion of the hot blow furnace 6A, and the webbing 1 is laid around the roller 6R and a roller 6E at the exit. A hot blow at 220°–230° C. is introduced from the webbing exit to the inside of the hot blow furnace 6A and brought into contact with the webbing 1 in a countercurrent manner. Accordingly, in the color developing zone 6D, the webbing 1 is in contact with a hot blow at a high temperature of about 210°–220° C. to conduct sufficient color development. Further, in the drying zone 6C, the webbing 1 is in contact with a hot blow at a lower temperature and dried. As can be seen from FIG. 3B, no guide rollers are disposed for the webbing 1 in the drying zone 6C of the hot blow furnace 6A, and the webbing 1 is brought into contact with the roller 6R after it is completely dried.

Figure 4B:
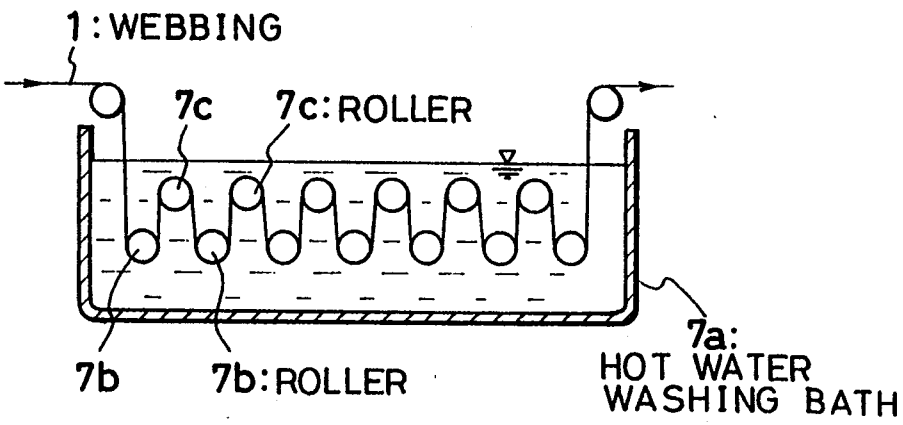
FIG. 4A and FIG. 4B are cross sectional views illustrating a water bath.
Figure 4A:
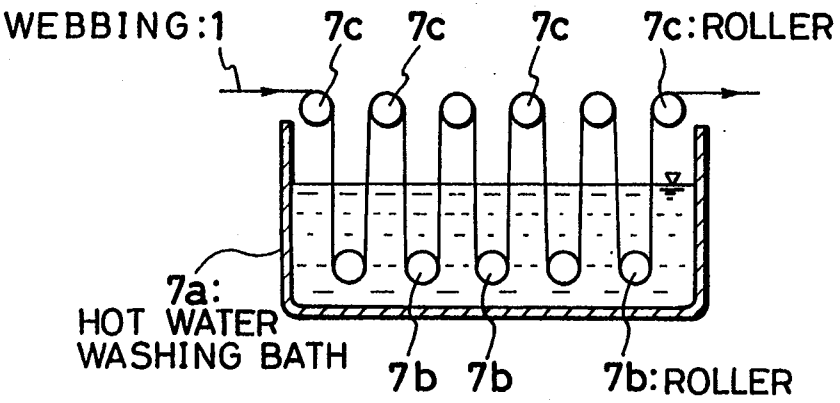

FIG. 4B shows a cleaning device used in this embodiment. The cleaning device is used for reduction cleaning and/or hot water washing. In this embodiment, all of rollers *7b*, *7c* are arranged in a water bath *7a*, and the webbing 1 immersed in a cleaning solution or hot water is bent on one side and then on the other side of the webbing 1 and then passed through the hot waiter while undergoing such repeating bending successively. Accordingly, the solution can intrude deeply into the fibrous tissue of the webbing 1, so that cleaning at an extremely high efficiency can be applied.

According to the dyeing method in this embodiment, since the raw material for the webbing 1 is at first removed with the oil agent and then sent to the padding step, the oil agent does not leach into the dye solution in the dye bath. Accordingly, contamination to the dye solution can be prevented.

Further, since the oil agent does not deposit on the webbing 1, contamination can be removed satisfactorily in the reduction cleaning step 8. Further, there is no contamination of the webbing caused by the oil agent that becomes tarry. In view of the above, a webbing that Finely develops a color can be obtained.

Further, in this embodiment, since the padded webbing is sent as it is without drying to the hot blow furnace 6A, additional drying step is no longer required, so that the entire constitution for the dyeing device can be simplified. Further, the number of rollers in contact with the wet webbing deposited with the dye is extremely small, and the first tensioner 5 is disposed prior to the dye padding step 3. Accordingly, the number of rolls that have to be cleaned upon color change of the dye is reduced, so that color of dye can be changed rapidly.

Furthermore, as described above, in the hot blow furnace 6a, the webbing 1 is brought into contact with the roller 6R only after it has been completely dried. Accordingly, the dye does not deposit on the roller 6R and the drying of the dye can also be prevented. Accordingly, there is no longer necessary to wash or clean the roller 6R upon color change of the dye, by which the color change can be made rapidly.

Furthermore, as has been described above, the webbing 1 can be cleaned sufficiently as shown in FIG. 4B, by which a webbing that finely develops a color can be produced.

In the above-mentioned embodiment, padding is applied by immersing the webbing in the dye solution, but padding may also be applied by spraying a dye solution.

Further, the hot blow furnace 6A is made elongate in the horizontal direction in FIG. 3B but it may be in a vertically elongate shape.

Description has been made to the embodiment described above, wherein the number of the rollers to be cleaned upon color change is reduced. Cleaning of the rollers may cause the lowering of the roller temperature, by which unevenness may possibly be caused in color development. On the contrary in this embodiment, since the number of rollers that are cleaned and the temperature of which is lowered upon color change is extremely small, it can also provide an effect capable of preventing uneven color development due to the lowering of the roller temperature.

In the above-mentioned embodiment, the webbing is sent into the resin padding step directly after the hot water washing step. This is because the webbing has extremely low water content and requires no drying step as described previously. Further, upon resin padding, since an aqueous dispersion type resin is used, the webbing may be moistened. By saving the drying step after the hot water washing, the step is further simplified as a whole.

As has been described above in accordance with the dyeing method of the present invention, the number of drying steps is extremely reduced as a whole and it is possible to simplify the constitution of the device and reduce the dyeing cost. In addition, since the number of rollers in contact with the moistened padded webbing is small, color change of dye can be conducted rapidly.

According to the method of the present invention, since padding is applied after removing the oil agent, contamination of the dye solution can be prevented and removal of contamination during reduction cleaning is satisfactory. Accordingly, a webbing that finely develops a color can be produced.

According to the dyeing method of the present invention, the dye does not deposit and dry to solidness on the rollers in the hot blow furnace and the maintenance and control for the hot blow furnace is facilitated. Further, the color change of the dye can be conducted more rapidly.

According to the dyeing method of the present invention, the webbing can be cleaned sufficiently, so that a webbing that finely develops a color can be produced.

What is claimed is:

1. A method of dyeing a webbing for a seat belt device, comprising the steps of:

washing a webbing, padding a dye to the webbing while the webbing is in a wet condition after said washing, introducing the webbing with the dye after padding the dye directly into a hot blow furnace sequentially having a drying zone, a roller and a color developing zone, said webbing being introduced at first to the drying zone for drying the webbing before contacting the roller, thereafter contacting with the roller and then introduced to the color developing zone for developement of color of the dye, and subsequently washing the webbing while completely dipping the webbing into a washing liquid and bending the webbing in two different directions so that washing is completed.

2. A method of dyeing a webbing according to claim 1, wherein said drying zone and developing zone are connected together to form one path, said webbing being transferred from the drying zone to the developing zone while hot air at 220°–23 ° C. is introduced from the developing zone to the drying zone.

3. A method of dyeing a webbing according to claim 1, wherein said washing step after dyeing includes a reduction cleaning and hot water washing.

4. A method of dyeing a webbing according to claim 3, further comprising a first tensioning step for applying tension to the webbing before the dye is applied to the webbing, and a second tensioning step for applying tension to the webbing after passing through the hot blow furnace.

5. A method of dyeing a webbing for a seat belt device, consisting essentially of:

washing a webbing, applying first tension to the webbing, padding a dye to the webbing while the webbing is in a wet condition after washing, introducing the webbing with the dye after padding the dye directly into a hot blow furnace sequentially having a drying zone, a roller and a color developing zone, said webbing being introduced at first to the drying zone for drying the webbing before contacting the roller, thereafter contacting with the roller and then introduced to the color developing zone for development of color of the dye, subsequently applying second tension to the webbing, washing the webbing while completely dipping the webbing into a washing liquid and bending the webbing in two different directions so that washing is completed, and providing resin treatment to the webbing.

6. A method of dyeing a webbing according to claim 5, wherein said drying zone and developing zone are connected together to form one path, said webbing being transferred from the drying zone to the developing zone while hot air at 220°–230° C. is introduced from the developing zone to the drying zone.

* * * * *